United States Patent [19]

Takenouchi et al.

[11] Patent Number: 4,617,052

[45] Date of Patent: Oct. 14, 1986

[54] PROCESS FOR PREPARING A MOTHER ALLOY FOR MAKING AMORPHOUS METAL

[75] Inventors: Tomoo Takenouchi; Yoshiaki Ichinomiya; Yoshiyuki Iwanami, all of Hokkaido, Japan

[73] Assignee: The Japan Steel Works Ltd., Tokyo, Japan

[21] Appl. No.: 771,078

[22] Filed: Aug. 30, 1985

[30] Foreign Application Priority Data

Jan. 28, 1985 [JP] Japan ..... 60-12489

[51] Int. Cl.[4] ..... C21C 33/00

[52] U.S. Cl. ..... 420/117; 420/121

[58] Field of Search ..... 75/129, 133, 123 B, 75/133.5

[56] References Cited

U.S. PATENT DOCUMENTS 4,440,568 4/1984 Staggers ..... 75/129

4,486,226 12/1984 Hildebrand ..... 75/129

4,509,976 4/1985 Zambrano ..... 75/129

*Primary Examiner*—Peter D. Rosenberg

*Attorney, Agent, or Firm*—Sughrue, Mion, Zinn, Macpeak & Seas

[57] ABSTRACT

A process for preparing a mother alloy for making a Fe-B-Si base amorphous metal is described, comprising the steps of:

providing a molten metal containing an iron source and ferrosilicon;

adding to the molten metal a mineral ore containing a boron oxide;

reducing a predetermined amount of the boron oxide in the molten metal by the reducing action of carbon or silicon that is initially present in the metal or externally added together with the mineral ore, thereby dissolving said boron oxide as elemental boron in the molten metal;

removing the carbon or aluminum by supplying an oxidant; and adjusting the contents of boron and silicon in the molten metal to be within a desired composition range.

10 Claims, 2 Drawing Figures

PROCESS FOR PREPARING A MOTHER ALLOY FOR MAKING AMORPHOUS METAL

FIELD OF USE

The present invention relates to a process for preparing a mother alloy for making an amorphous metal.

BACKGROUND OF THE INVENTION

Because of their desirable qualities in terms of magnetic and other properties, amorphous alloys are currently used in magnetic heads in audio and video tape recorders, and the scope of their application is expected to expand in the years to come. Another advantage of amorphous alloys is low iron loss, and thus they can desirably replace silicon steel sheets used in transformer cores, another factor that will contribute to the rapid increase in the volume of amorphous metals to be used in the future. An amorphous metal that holds much promise for use in the core of a transformer is a relatively inexpensive Fe-B-Si base alloy containing boron and silicon in respective amounts of approximately 3% and 5% by weight, based on the total weight.

The conventional processes for the production of amorphous metals are basically the same, comprising an iron source mixed with alloy materials such as Fe-B and Fe-Si to give the desired composition being melted and then quenched rapidly. However, this approach is not ideal for the purpose of obtaining amorphous products of consistent quality, since it often involves great deviations from the intended alloy composition.

In order to replace silicon steel sheets used in the transformer core, amorphous metals have to be produced at a cost higher than about 1.5 times the cost for the production of silicon steel sheets, and such requires, for one thing, the use of an inexpensive mother alloy. However, if a commercial, rather expensive Fe-B is used as a mother alloy, the price of the final product becomes so high as to make commercial production practically impossible.

SUMMARY OF THE INVENTION

The principal object, therefore, of the present invention is to provide a process for producing an amorphous alloy at low cost and without the occurrence of excessively great deviations from the intended alloy composition. In order to attain this object, the invention, rather than producing an amorphous alloy directly from an iron source and alloying materials such as Fe-B and Fe-Si, prepares a mother alloy by first reducing an inexpensive $B_2O_3$ and then providing the respective components to provide the intended composition with high precision.

In one aspect, the present invention relates to a process for preparing a mother alloy for making a Fe-B-Si base amorphous metal with decarburization with oxygen in vacuo, comprising the steps of:

providing a molten metal containing an iron source and ferrosilicon;

adding to the molten metal a mineral ore containing a boron oxide;

reducing a predetermined amount of the boron oxide in the molten metal by the reducing action of carbon that is initially present in the metal or externally added together with the mineral ore, thereby dissolving said boron oxide as elemental boron in the molten metal;

removing the carbon preferentially by supplying an oxidant in vacuo; and adjusting the contents of boron and silicon in the molten metal to be within a desired composition range.

In another aspect, the invention relates to a process for preparing a mother alloy for making a Fe-B-Si base amorphous metal with the removal of aluminum, comprising the steps of:

providing a molten metal containing an iron source and ferrosilicon;

adding to the molten metal a mineral ore containing a boron oxide;

reducing a predetermined amount of the boron oxide in the molten metal by the reduction action of silicon or aluminum that is initially present in the metal or externally added together with the mineral ore, thereby dissolving said boron oxide as elemental boron in the molten metal;

removing aluminum preferentially by supplying an oxidant, such as an iron oxide; and adjusting the contents of boron and silicon in the molten metal to be within a desired composition range.

BRIEF DESCRIPTION OF THE INVENTION

FIG. 1 is a graph showing the time-dependent profiles of carbon and boron contents in Fe-B-C molten steel subjected to laboratory-scale oxidation in vacuo; and FIG. 2 is a graph showing the time-dependent profiles of aluminum and boron contents in Fe-B-Al molten steel subjected to laboratory-scale oxidation at one atmosphere.

DETAILED DESCRIPTION OF THE INVENTION

Figure 1:
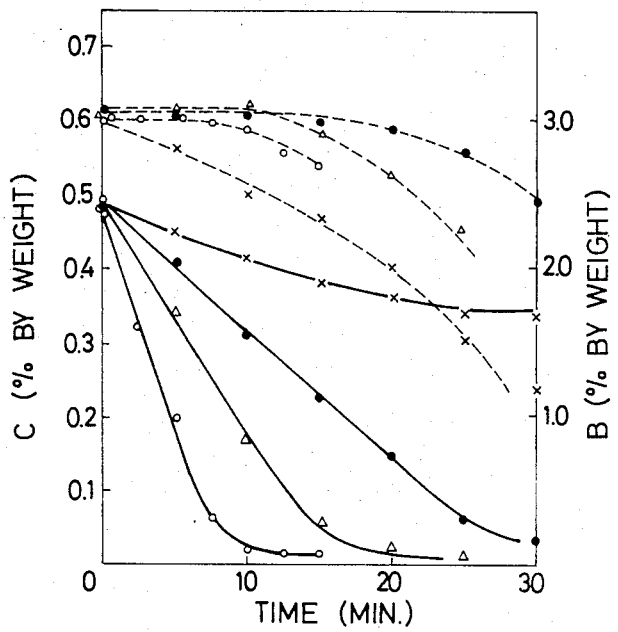

The present invention relates to a process for preparing a mother amorphous alloy having a desired Fe-B-Si base composition. Amorphous products having consistent quality can be obtained by re-melting this mother alloy and quenching it rapidly.

Boron is bonded to oxygen fairly strongly, so the current practice of Fe-B production predominantly depends on reducing boric acid with aluminum. However, there is high likelihood that boron combined with oxygen can be reduced to the elemental form by carbon or silicon if it is used in sufficiently high concentrations to appreciably increase the activity, and hence reactivity, of the boron.

In order to confirm this assumption, the present inventors conducted laboratory-scale experiments on the reduction of combined boron in $B_2O_3$ ores to the elemental form by the following procedure. Batches of steel (3 kg) containing carbon (C), silicon (Si) and/or aluminum (Al) as reducing agents in a graphite or alumina crucible were melted by rf (radio frequency) heating. As the batches were held at 1550° C., a $B_2O_3$ ore or a colemanite ore (including 55 wt% $B_2O_3$, 32 wt% CaO, and 6 wt% $SiO_2$) was added to the surface of the melt in such divided amounts that either would produce 4 wt% boron upon complete reduction. The contents of boron in the batches of melt are shown in Table 1.

TABLE 1

| Batch No. | Ore | Initial concentrations wt % C | Si | Al | Final boron conc. wt % | Percent reduction |
|---|---|---|---|---|---|---|
| 1 | $B_2O_3$ | 4 | — | — | 2.07 | 51.8 |
| 2 | " | — | 7 | — | 2.60 | 65.0 |

TABLE 1-continued

| Batch No. | Ore | Initial concentrations wt % C | Si | Al | Final boron conc. wt % | Percent reduction |
|---|---|---|---|---|---|---|
| 3 | " | — | — | 10 | 3.45 | 86.3 |
| 4 | " | 3 | 5 | 3 | 3.21 | 80.3 |
| 5 | colemanite | 4 | — | — | 2.33 | 58.3 |
| 6 | " | — | 7 | — | 2.94 | 73.5 |
| 7 | " | — | — | 10 | 3.55 | 88.8 |
| 8 | " | 3 | 5 | 3 | 3.28 | 82.0 |
| 9 | " | 4 | — | — | 2.75 | 68.8 |
| 10 | " | 4 | 5 | — | 3.01 | 75.3 |
| 11 | " | 4 | — | 3 | 3.29 | 82.3 |
| 12 | " | 4 | 5 | 3 | 3.40 | 85.0 |

The above data show that each of the batches tested achieved a reduction yield of more than 50%. Since both colemanite and $B_2O_3$ are available at far lower cost than Fe-B, the method of reduction according to the present invention appears to be commercially feasible and desirable.

It is desired that the amorphous metal to be produced from the mother alloy in accordance with the present invention contains aluminum in an amount of not more than 0.010 wt% and carbon in an amount of not more than 0.10 wt% from the viewpoints of both process and quality requirements. Therefore, carbon of aluminum must be preferentially removed from the molten metal prepared by the process described above. If the carbon monoxide gas in the melting furnace has one atmospheric partial pressure (Pco) carbon binds with oxygen as strongly as silicon does, so preferential oxidation of carbon is impossible even in the presence of an externally added oxidant. This means that preferential decarburization must be realized by supplying an oxygen source such as oxygen gas in vacuo. If, on the other hand, aluminum rather than carbon is used as a reducing agent, preferential oxidation of aluminum is expected to take place readily by supplying an oxygen source such as iron oxide to the molten metal.

Figure 2:
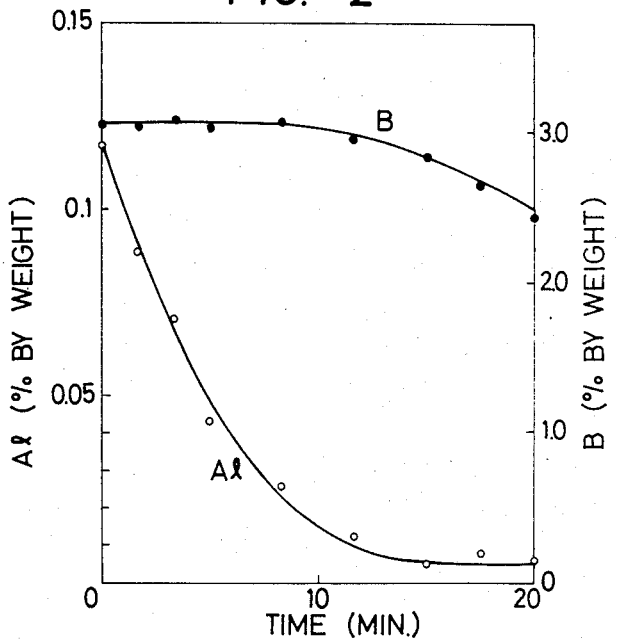

FIGS. 1 and 2 show the results of two experiments the present inventors conducted in order to confirm the foregoing statements. In one experiment, a steel (1 kg) containing 0.5 wt% C and 3 wt% B in an alumina crucible was melted in an argon atmosphere and an oxygen gas was blown against the surface of the melt either at one atmosphere or under predetermined subatmospheric pressures. The time-dependent profiles of carbon and boron contents in the melt are depicted in FIG. 1, wherein the solid line and the dashed line respectively plot for various pressures, i.e., 10 Torr ( ), 50 Torr (Δ), 100 Torr ( ) and 760 Torr (X). As is apparent from FIG. 1, the contents of carbon and boron are reduced simultaneously in an argon atmosphere, but as the pressure is decreased progressively, decarburization occurs preferentially and at 100 Torr or below, the carbon content can be decreased to 0.1 wt% or below with negligible oxidation of boron taking place. Therefore, it can be concluded that if carbon is used as a reducing agent, preferential removal of carbon can be realized by blowing an oxygen gas into the melt in vacuo.

In the other experiment, a steel (3 kg) containing 3 wt% B and 0.1 wt% Al in an alumina crucible was melted and an iron oxide was continuously added to the surface of the melt as an oxidant at one atmosphere. The time-dependent profiles of aluminum ( ) and boron ( ) contents in the melt are shown in FIG. 2, from which one can see that the aluminum content can be decreased to 0.01 wt% or below with negligible oxidation of boron taking place. It is therefore concluded that if aluminum is used as a reducing agent, preferential removal of aluminum can be realized by adding an iron oxide or any other suitable oxidant to the melt.

The following Examples are provided for further illustrations of the present invention but are by no means intended as limiting the same.

EXAMPLE 1

(Decarburization with oxygen in vacuum)

The results of an industrial-scale test of the titled method are summarized in Table 2. An alumina-lined electric arc furnace (10 t) was charged with an iron source (scrap) and Fe-Si (ferrosilicon). The charge was melted to form a heated mass (6 t) having the initial composition (before reduction) as shown in Table 2. Anhydrous colemanite was added to the surface of the melt in such an amount that it would produce 4 wt% B in the melt upon complete reduction. The colemanite ($B_2O_3$) was reduced by carbon initially present in the melt so that elemental boron would dissolve in the melt to provide the composition (after reduction) indicated in Table 2. The thus-treated melt was poured into a ladle where it was decarburized with oxygen gas that was blown at a pressure of 50 Torr, thereby producing the composition (after decarburization) shown in Table 2. The melt was finally adjusted to have the intended composition by addition of low-Al content Fe-Si and Fe-B.

TABLE 2

| | Composition wt % C | Si | B |
|---|---|---|---|
| Before reduction | 3.52 | 4.83 | <0.01 |
| After reduction | 0.53 | 2.06 | 3.12 |
| After decarburization | 0.06 | 0.53 | 2.85 |
| Final | 0.06 | 4.96 | 3.01 |

EXAMPLE 2

(Removal of aluminum in ladle)

A batch of molten steel (6 t) having the composition (before reduction) shown in Table 3 was treated as in Example 1 to provide the composition (after reduction) noted in Table 3. The reduced melt was poured into a ladle having 180 kg of an iron oxide in the bottom, and freed of aluminum by oxidation under agitation while argon gas was supplied into the ladle from the bottom. The melt was finally adjusted to have the intended composition shown in Table 3 by addition of low-Al content Fe-Si and Fe-B.

TABLE 3

| | Composition wt % C | Si | Al | B |
|---|---|---|---|---|
| Before reduction | 0.04 | 7.03 | <0.01 | <0.01 |
| After reduction | 0.05 | 4.15 | 0.21 | 2.95 |
| After oxidation | 0.04 | 3.83 | 0.006 | 2.80 |
| Final | 0.04 | 5.07 | 0.006 | 2.98 |

From the foregoing, it is clear that the present invention enables the production of amorphous mother alloys of consistent quality from inexpensive mineral ores; thus great commercial advantages result from the practice of the invention.

While the invention has been described in detail and with reference to specific embodiments thereof, it will be apparent to one skilled in the art that various changes and modifications can be made therein without departing from the spirit and scope thereof.

We claim:

1. A process for preparing a mother alloy for making a Fe-B-Si base amorphous metal, comprising the steps of:

providing a molten metal containing an iron source and ferrosilicon;

adding to the molten metal a mineral ore containing a boron oxide;

reducing a predetermined amount of the boron oxide in the molten metal by the reducing action of carbon or aluminum that is initially present in the metal or externally added together with the mineral ore, thereby dissolving said boron oxide as elemental boron in the molten metal;

removing the carbon or aluminum by supplying an oxidant; and adjusting the contents of boron and silicon in the molten metal to be within a desired composition range.

2. A process for preparing a mother alloy as in claim 1, wherein the boron oxide is reduced by the reducing action of carbon, and the carbon is preferentially removed by supplying an oxygen source in vacuum.

3. A process for preparing a mother alloy as in claim 1, wherein the boron oxide is reduced by the reducing action of aluminum, and the aluminum is preferentially removed by supplying an oxidant.

4. A process for preparing a mother alloy as in claim 2, wherein the oxygen source in vacuo is oxygen gas.

5. A process for preparing a mother alloy as in claim 3, wherein said oxidant is iron oxide.

6. A process for preparing a mother alloy as in claim 1, wherein the contents of boron and silicon in the molten metal are adjusted by addition of low-Al content Fe-Si and Fe-B.

7. A process for preparing a mother alloy as in claim 2, wherein the contents of boron and silicon in the molten metal are adjusted by addition of low-Al content Fe-Si and Fe-B.

8. A process for preparing a mother alloy as in claim 3, wherein the contents of boron and silicon in the molten metal are adjusted by addition of low-Al content Fe-Si and Fe-B.

9. A process for preparing a mother alloy as in claim 4, wherein the contents of boron and silicon in the molten metal are adjusted by addition of low-Al content Fe-Si and Fe-B.

10. A process for preparing a mother alloy as in claim 5, wherein the contents of boron and silicon in the molten metal are adjusted by addition of low-Al content Fe-Si and Fe-B.

* * * * *

REEXAMINATION CERTIFICATE (1144th)

United States Patent [19]

Takenouchi et al.

[11] B1 4,617,052

[45] Certificate Issued Oct. 17, 1989

[54] PROCESS FOR PREPARING A MOTHER ALLOY FOR MAKING AMORPHOUS METAL

[76] Inventors: Tomoo Takenouchi; Yoshiaki Ichinomiya; Yoshiyuki Iwanami, all of Hokkaido, Japan

Reexamination Request:
No. 90/001,207, Mar. 31, 1987

Reexamination Certificate for:

| | |
|---|---|
| Patent No.: | **4,617,052** |
| Issued: | **Oct. 14, 1986** |
| Appl. No.: | **771,078** |
| Filed: | **Aug. 30, 1985** |

[30] Foreign Application Priority Data

Jan. 28, 1985 [JP] Japan ..... 60-12489

[51] Int. Cl.[4] ..... C21C 33/00

[52] U.S. Cl. ..... 420/129; 420/117; 420/121

[58] Field of Search ..... 420/117, 121

[56] References Cited

U.S. PATENT DOCUMENTS

| | | | |
|---|---|---|---|
| 4,036,638 | 7/1977 | Ray et al. | 75/123 |
| 4,505,745 | 3/1985 | Hameda et al. | 75/129 |
| 4,572,747 | 2/1986 | Sussman et al. | 148/3 |

FOREIGN PATENT DOCUMENTS

| | | |
|---|---|---|
| 026025 | 2/1983 | Japan . |
| 197252 | 11/1983 | Japan . |

*Primary Examiner*—Peter D. Rosenberg

[57] ABSTRACT

A process for preparing a mother alloy for making a Fe-B-Si base amorphous metal is described, comprising the steps of:

providing a molten metal containing an iron source and ferrosilicon;

adding to the molten metal a mineral ore containing a boron oxide;

reducing a predetermined amount of the boron oxide in the molten metal by the reducing action of carbon or silicon that is initially present in the metal or externally added together with the mineral ore, thereby dissolving said boron oxide as elemental boron in the molten metal;

removing the carbon or aluminum by supplying an oxidant; and adjusting the contents of boron and silicon in the molten metal to be within a desired composition range.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-10 are cancelled.

* * * * *